US009725958B2

(12) United States Patent
Radford et al.

(10) Patent No.: US 9,725,958 B2
(45) **Date of Patent: *Aug. 8, 2017**

(54) EARTH-BORING TOOLS INCLUDING EXPANDABLE MEMBERS AND STATUS INDICATORS AND METHODS OF MAKING AND USING SUCH EARTH-BORING TOOLS

(71) Applicant: Baker Hughes Incorporated, Houston, TX (US)

(72) Inventors: Steven R. Radford, The Woodlands, TX (US); Khoi Q. Trinh, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 287 days.

This patent is subject to a terminal disclaimer.

(21) Appl. No.: 14/593,389

(22) Filed: Jan. 9, 2015

(65) Prior Publication Data

US 2015/0114715 A1 Apr. 30, 2015

Related U.S. Application Data

(63) Continuation of application No. 13/252,454, filed on Oct. 4, 2011, now Pat. No. 8,939,236.

(Continued)

(51) Int. Cl.
*E21B 10/32* (2006.01)
*E21B 21/08* (2006.01)

(52) U.S. Cl.
CPC ..... *E21B 10/322* (2013.01); *E21B 21/08* (2013.01)

(58) Field of Classification Search
CPC ..... E21B 10/322; E21B 10/345; E21B 21/08

(Continued)

(56) References Cited

U.S. PATENT DOCUMENTS 1,678,075 A 7/1928 Phipps
2,069,482 A 2/1937 Seay (Continued)

FOREIGN PATENT DOCUMENTS

CN 2630464 Y 8/2004
CN 1717528 A 1/2006

(Continued)

OTHER PUBLICATIONS

U.S. Appl. No. 60/399,531, filed Jul. 30, 2002, titled Expandable Reamer Apparatus for Enlarging Boreholes While Drilling and Method of Use, to Radford et al.

(Continued)

*Primary Examiner* — Robert E Fuller
*Assistant Examiner* — David Carroll
(74) *Attorney, Agent, or Firm* — TraskBritt

(57) ABSTRACT

Expandable tools for use in subterranean boreholes may include a body defining a fluid flow path extending through the body. A valve piston may be located within the fluid flow path of the body, the valve piston configured to move longitudinally within the body responsive to drilling fluid flowing through the fluid flow path above a threshold pressure. The valve piston may include a nozzle defining an opening at an end of the valve piston. A status indicator may be located within the flow path of the body, the status indicator being fixed relative to the body. The status indicator may be positioned and shaped to alter a cross-sectional area of the opening of the nozzle by at least partially entering the nozzle responsive to the valve piston moving longitudinally within the body.

20 Claims, 7 Drawing Sheets

Related U.S. Application Data

(60) Provisional application No. 61/389,578, filed on Oct. 4, 2010.

(58) Field of Classification Search
USPC ..... 137/504, 517; 138/46; 73/152.01; 175/45, 269, 281, 288, 291
See application file for complete search history.

(56) References Cited

U.S. PATENT DOCUMENTS 2,136,518 A 11/1938 Nixon
2,177,721 A 10/1939 Johnson et al.
2,273,888 A 2/1942 Paulsen
2,344,598 A 3/1944 Church
2,532,418 A 12/1950 Page
2,638,988 A 5/1953 Williams
2,754,089 A 7/1956 Kammerer, Jr.
2,758,819 A 8/1956 Kammerer, Jr.
2,834,578 A 5/1958 Carr
2,874,784 A 2/1959 Baker, Jr. et al.
2,882,019 A 4/1959 Carr et al.
3,083,765 A 4/1963 Kammerer
3,105,562 A 10/1963 Stone et al.
3,123,162 A 3/1964 Rowley
3,126,065 A 3/1964 Chadderdon
3,171,502 A 3/1965 Kammerer
3,211,232 A 10/1965 Grimmer
3,220,478 A * 11/1965 Kinzbach ..... E21B 29/005 166/55.8
3,221,767 A 12/1965 McCarty et al.
3,224,507 A 12/1965 Cordary, Jr.
3,283,834 A 11/1966 Kammerer
3,289,760 A 12/1966 Kammerer
3,351,137 A 11/1967 Schulz et al.
3,425,500 A 2/1969 Fuchs
3,433,313 A 3/1969 Brown
3,503,585 A 3/1970 Vogeli
3,537,623 A * 11/1970 Fisher ..... B65D 47/122 222/460
3,556,233 A 1/1971 Gilreath
3,952,776 A 4/1976 Eversole
4,064,951 A 12/1977 Weber
4,184,545 A 1/1980 Claycomb
4,392,527 A 7/1983 Hauk et al.
4,403,659 A 9/1983 Upchurch
4,458,761 A 7/1984 Van Vreeswyk
4,491,022 A 1/1985 De La Cruz
4,515,225 A * 5/1985 Dailey ..... E21B 4/00 175/40
4,545,441 A 10/1985 Williamson
4,550,392 A 10/1985 Mumby
4,589,504 A 5/1986 Simpson
4,635,738 A 1/1987 Schillinger et al.
4,660,657 A 4/1987 Furse et al.
4,690,229 A 9/1987 Raney
4,693,328 A 9/1987 Furse et al.
4,842,083 A 6/1989 Raney
4,848,490 A 7/1989 Anderson
4,854,403 A 8/1989 Ostertag et al.
4,884,477 A 12/1989 Smith et al.
4,889,197 A 12/1989 Boe
4,893,678 A 1/1990 Stokley et al.
5,139,098 A 8/1992 Blake
5,211,241 A 5/1993 Mashaw et al.
5,224,558 A 7/1993 Lee
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A * 6/1994 Dewey ..... E21B 23/04 175/74
5,332,048 A 7/1994 Underwood et al.
5,343,963 A 9/1994 Bouldin et al.
5,361,859 A 11/1994 Tibbitts
5,368,114 A 11/1994 Tandberg et al.
5,375,662 A 12/1994 Echols, III et al.
5,402,856 A 4/1995 Warren et al.
5,425,423 A 6/1995 Dobson et al.
5,437,308 A 8/1995 Morin et al.
5,443,129 A 8/1995 Bailey et al.
5,495,899 A 3/1996 Pastusek
5,553,678 A 9/1996 Barr et al.
5,560,440 A 10/1996 Tibbitts et al.
5,740,864 A 4/1998 de Hoedt et al.
5,788,000 A 8/1998 Maury et al.
5,823,254 A 10/1998 Dobson et al.
5,862,870 A 1/1999 Hutchinson et al.
5,887,655 A 3/1999 Haugen et al.
5,957,223 A 9/1999 Doster et al.
6,039,131 A 3/2000 Beaton
6,059,051 A 5/2000 Jewkes et al.
RE36,817 E 8/2000 Pastusek
6,109,354 A 8/2000 Ringgenberg et al.
6,116,336 A 9/2000 Adkins et al.
6,131,675 A 10/2000 Anderson
6,173,795 B1 1/2001 McGarian et al.
6,189,631 B1 2/2001 Sheshtawy
6,213,226 B1 4/2001 Eppink et al.
6,227,312 B1 5/2001 Eppink et al.
6,289,924 B1 9/2001 Kozinski
6,289,999 B1 9/2001 Dewey et al.
6,325,151 B1 12/2001 Vincent et al.
6,328,061 B1 12/2001 Kozinski
6,360,831 B1 3/2002 Akesson et al.
6,378,632 B1 4/2002 Dewey et al.
6,488,104 B1 12/2002 Eppink et al.
6,494,272 B1 12/2002 Eppink et al.
6,615,933 B1 9/2003 Eddison
6,668,936 B2 12/2003 Williamson, Jr. et al.
6,668,949 B1 12/2003 Rives
6,681,860 B1 1/2004 Yokley et al.
6,702,020 B2 3/2004 Zachman et al.
6,708,785 B1 3/2004 Russell et al.
6,732,817 B2 5/2004 Dewey et al.
6,889,771 B1 5/2005 Leising et al.
7,036,611 B2 5/2006 Radford et al.
7,048,078 B2 5/2006 Dewey et al.
7,082,821 B2 * 8/2006 Chen ..... E21B 44/00 175/40
7,308,937 B2 12/2007 Radford et al.
7,314,099 B2 1/2008 Dewey et al.
7,357,198 B2 4/2008 Mcgarian et al.
7,389,828 B2 6/2008 Ritter et al.
7,513,318 B2 4/2009 Underwood et al.
7,900,717 B2 3/2011 Radford et al.
8,011,448 B2 * 9/2011 Tulloch ..... E21B 7/04 175/325.1
8,235,144 B2 8/2012 Rasheed
8,511,404 B2 8/2013 Rasheed
8,528,668 B2 9/2013 Rasheed
8,540,035 B2 9/2013 Xu et al.
8,939,236 B2 * 1/2015 Radford ..... E21B 10/322 175/269
9,097,820 B2 8/2015 Rasheed
2001/0045300 A1 11/2001 Fincher et al.
2002/0070052 A1 6/2002 Armell
2003/0029644 A1 2/2003 Hoffmaster et al.
2003/0155155 A1 8/2003 Dewey et al.
2004/0060710 A1 4/2004 Marshall
2004/0119607 A1 6/2004 Davies et al.
2004/0134687 A1 7/2004 Radford et al.
2006/0207797 A1 9/2006 Dewey et al.
2006/0225885 A1 10/2006 Mcgarian et al.
2006/0249307 A1 11/2006 Ritter et al.
2007/0163808 A1 7/2007 Campbell et al.
2007/0205022 A1 9/2007 Treviranus et al.
2008/0128169 A1 * 6/2008 Radford ..... E21B 10/322 175/57
2008/0128175 A1 6/2008 Radford et al.
2009/0032308 A1 2/2009 Eddison
2009/0173541 A1 7/2009 Tulloch et al.
2010/0006339 A1 1/2010 Desai

(56) References Cited

U.S. PATENT DOCUMENTS

| | | | | |
|---|---|---|---|---|
| 2010/0089583 | A1 | 4/2010 | Xu et al. | |
| 2010/0108394 | A1 | 5/2010 | Ollerenshaw et al. | |
| 2010/0224414 | A1 | 9/2010 | Radford et al. | |
| 2010/0282511 | A1 | 11/2010 | Maranuk et al. | |
| 2011/0284233 | A1* | 11/2011 | Wu | E21B 10/32 166/321 |
| 2012/0080228 | A1 | 4/2012 | Radford et al. | |
| 2013/0333879 | A1 | 12/2013 | Rasheed | |
| 2014/0060933 | A1 | 3/2014 | Rasheed | |

FOREIGN PATENT DOCUMENTS

| | | | |
|---|---|---|---|
| CN | 1816679 | A | 8/2006 |
| CN | 201106404 | Y | 2/2008 |
| CN | 101589205 | A | 11/2009 |
| CN | 101657601 | A | 2/2010 |
| EP | 246789 | A2 | 11/1987 |
| EP | 0594420 | A1 | 4/1994 |
| EP | 1036913 | A1 | 10/2002 |
| EP | 1044314 | A1 | 3/2005 |
| EP | 1614852 | A1 | 11/2006 |
| EP | 2327857 | B1 | 3/2014 |
| GB | 2328964 | A | 3/1999 |
| GB | 2344607 | A | 6/2000 |
| GB | 2319276 | B | 2/2001 |
| GB | 2353310 | A | 2/2001 |
| GB | 2344122 | B | 4/2003 |
| GB | 2408272 | A | 5/2005 |
| GB | 2393461 | B | 10/2006 |
| GB | 2426269 | B | 2/2007 |
| GB | 2441286 | B | 3/2008 |
| GB | 2438333 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |
| GB | 2476653 | A | 6/2011 |
| GB | 2455242 | B | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 0031371 | A1 | 6/2000 |
| WO | 2008/150290 | A1 | 12/2008 |
| WO | 2009/156552 | A1 | 12/2009 |
| WO | 2011/080640 | A2 | 7/2011 |
| WO | 2013/166393 | A1 | 11/2013 |

OTHER PUBLICATIONS

Definition of "Nozzle", Cambridge Dictionary, Cambridge University Press Copyright 2014, 1 page.

International Search Report for International Application No. PCT/US2011/054707 mailed Jan. 9, 2012, 3 pages.

International Written Opinion for International Application No. PCT/US2011/054707 mailed Jan. 9, 2012, 4 pages.

International Preliminary Report on Patentability for International Application No. PCT/US2011/054707 dated Apr. 9, 2013, 5 pages.

Chinese First Office Action for Chinese Application No. 201180055074 dated Aug. 4, 2014, 12 pages.

Chinese Search Report for Chinese Application No. 201180055074 datedJul. 28, 2014, 2 pages.

* cited by examiner

EARTH-BORING TOOLS INCLUDING EXPANDABLE MEMBERS AND STATUS INDICATORS AND METHODS OF MAKING AND USING SUCH EARTH-BORING TOOLS

CROSS-REFERENCE TO RELATED APPLICATION

This application is a continuation of U.S. patent application Ser. No. 13/252,454, filed Oct. 4, 2011, now U.S. Pat. No. 8,939,236, issued Jan. 27, 2015, which application claims the benefit of the filing date of U.S. Provisional Patent Application Ser. No. 61/389,578, filed Oct. 4, 2010, titled "STATUS INDICATORS FOR USE IN EARTH-BORING TOOLS HAVING EXPANDABLE REAMERS AND METHODS OF MAKING AND USING SUCH STATUS INDICATORS AND EARTH-BORING TOOLS," the disclosure of which is incorporated herein in its entirety by this reference.

FIELD

Embodiments of the present disclosure relate generally to status indicators for tools for use in subterranean boreholes and, more particularly, to remote status indicators for determining whether expandable reamer apparatuses are in expanded or retracted positions.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operations to achieve greater depths. Casing is also conventionally installed to isolate different formations, to prevent crossflow of formation fluids, and to enable control of formation fluids and pressures as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present disclosure. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present disclosure.

Another conventional approach used to enlarge a subterranean borehole includes employing an extended bottom hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom hole assembly is particularly significant in directional drilling. The assignee of the present disclosure has, to this end, designed as reaming structures so called "reamer wings," which generally comprise a tubular body having a fishing neck with a threaded connection at the top thereof and a tong die surface at the bottom thereof, also with a threaded connection. For example, U.S. Pat. Nos. RE 36,817 and 5,495,899, both of which are assigned to the assignee of the present disclosure, disclose reaming structures including reamer wings. The upper midportion of the reamer wing tool includes one or more longitudinally extending blades projecting generally radially outwardly from the tubular body, and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments of the disclosure, when read in conjunction with the accompanying drawings, in which:

DETAILED DESCRIPTION

The illustrations presented herein are, in some instances, not actual views of any particular earth-boring tool, expandable reamer apparatus, status indicator, or other feature of an earth-boring tool, but are merely idealized representations that are employed to describe embodiments the present disclosure. Additionally, elements common between figures may retain the same numerical designation.

As used herein, the terms "distal," "proximal," "top," and "bottom" are relative terms used to describe portions of an expandable apparatus, sleeve, or sub with reference to the surface of a formation to be drilled. A "distal" or "bottom" portion of an expandable apparatus, sleeve, or sub is the portion relatively more distant from the surface of the formation when the expandable apparatus, sleeve, or sub is disposed in a borehole extending into the formation during a drilling or reaming operation. A "proximal" or "top" portion of an expandable apparatus, sleeve, or sub is the portion in closer relative proximity to the surface of the formation when the expandable apparatus, sleeve, or sub is disposed in a borehole extending into the formation during a drilling or reaming operation.

Figure 1:
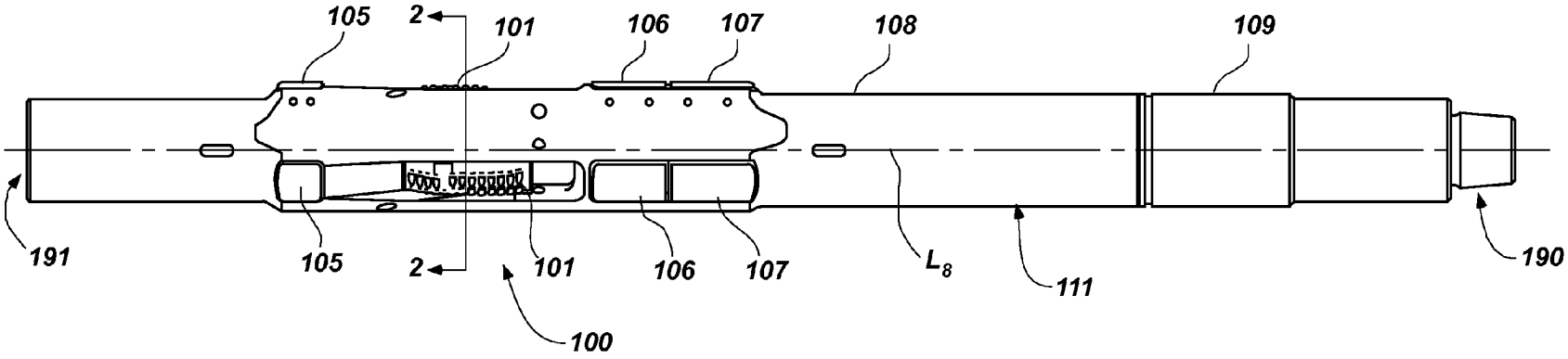
FIG. 1 is a side view of an embodiment of an expandable reamer apparatus of the disclosure.

An example embodiment of an expandable reamer apparatus 100 of the disclosure is shown in FIG. 1. The expandable reamer apparatus 100 may include a generally cylindrical tubular body 108 having a longitudinal axis $L_8$. The tubular body 108 of the expandable reamer apparatus 100 may have a distal end 190, a proximal end 191, and an outer surface 111. The distal end 190 of the tubular body 108 of the expandable reamer apparatus 100 may include threads (e.g., a threaded male pin member) for connecting the distal end 190 to another section of a drill string or another component of a bottom-hole assembly (BHA), such as, for example, a drill collar or collars carrying a pilot drill bit for drilling a borehole. In some embodiments, the expandable reamer apparatus 100 may include a lower sub 109 that connects to the lower box connection of the reamer body 108. Similarly, the proximal end 191 of the tubular body 108 of the expandable reamer apparatus 100 may include threads (e.g., a threaded female box member) for connecting the proximal end 191 to another section of a drill string (e.g., an upper sub (not shown)) or another component of a bottom-hole assembly (BHA).

Three sliding members (e.g., blades 101, stabilizer blocks, etc.) are positionally retained in circumferentially spaced relationship in the tubular body 108 as further described below and may be provided at a position along the expandable reamer apparatus 100 intermediate the first distal end 190 and the second proximal end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100, but may be moved responsive to application of hydraulic pressure into the extended position and moved into a retracted position when desired. The expandable reamer apparatus 100 may be configured such that the blades 101 engage the walls of a subterranean formation surrounding a borehole in which expandable reamer apparatus 100 is disposed to remove formation material when the blades 101 are in the extended position, but are not operable to engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis Lg along the tubular body 108, the blades may also be positioned circumferentially asymmetrically as well as asymmetrically about the longitudinal axis $L_8$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hard face pads 105, mid hard face pads 106, and lower hard face pads 107.

Figure 2:
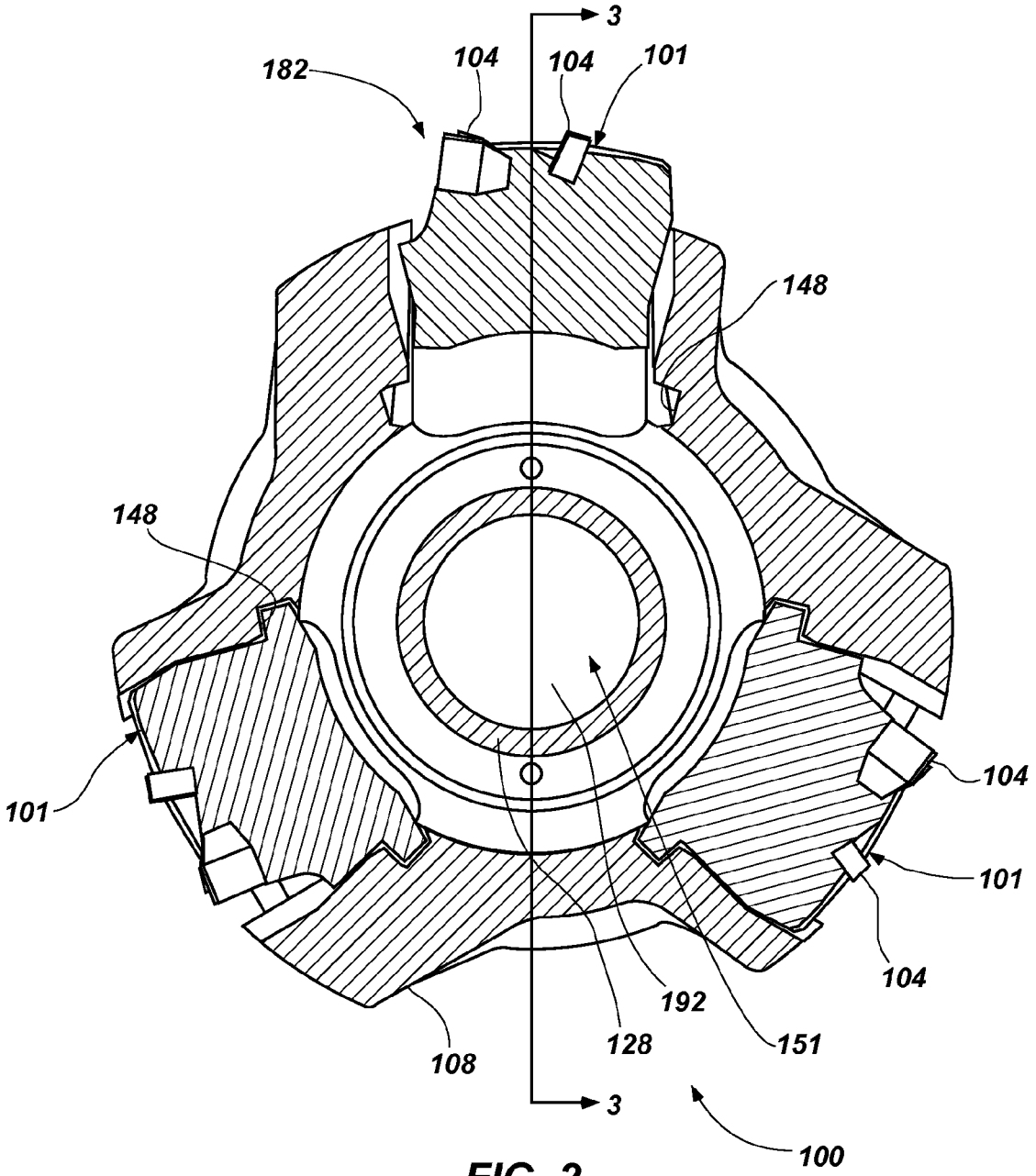
FIG. 2 shows a transverse cross-sectional view of the expandable reamer apparatus in the plane indicated by section line 2-2 in FIG. 1.

FIG. 2 is a cross-sectional view of the expandable apparatus 100 shown in FIG. 1 taken along section line 2-2 shown therein. As shown in FIG. 2, the tubular body 108 encloses a fluid passageway 192 that extends longitudinally through the tubular body 108. The fluid passageway 192 directs fluid substantially through an inner bore 151. Fluid may travel through the fluid passageway 192 in a longitudinal bore 151 of the tubular body 108 (and a longitudinal bore of a valve piston 128) in a bypassing relationship to substantially shield the blades 101 from exposure to drilling fluid, particularly in the lateral direction, or normal to the longitudinal axis $L_8$ (FIG. 1). The particulate-entrained fluid is less likely to cause build-up or interfere with the operational aspects of the expandable reamer apparatus 100 by shielding the blades 101 from exposure with the fluid. However, it is recognized that beneficial shielding of the blades 101 is not necessary to the operation of the expandable reamer apparatus 100 where, as explained in further detail below, the operation (i.e., extension from the initial position, the extended position and the retracted position) occurs by an axially directed force that is the net effect of the fluid pressure and spring biases forces. In this embodiment, the axially directed force directly actuates the blades 101 by axially influencing an actuating feature, such as a push sleeve 115 (shown in FIG. 3), for example, and without limitation, as described herein below.

Referring to FIG. 2, to better describe aspects of the disclosure, one of blades 101 is shown in the outward or extended position while the other blades 101 are shown in the initial or retracted positions. The expandable reamer apparatus 100 may be configured such that the outermost radial or lateral extent of each of the blades 101 is recessed within the tubular body 108 when in the initial or retracted positions so as to not extend beyond the greatest extent of an outer diameter of the tubular body 108. Such an arrangement may protect the blades 101 as the expandable reamer apparatus 100 is disposed within a casing of a borehole, and may enable the expandable reamer apparatus 100 to pass through such casing within a borehole. In other embodiments, the outermost radial extent of the blades 101 may coincide with or slightly extend beyond the outer diameter of the tubular body 108. The blades 101 may extend beyond the outer diameter of the tubular body 108 when in the extended position, to engage the walls of a borehole in a reaming operation.

The three sliding blades 101 may be retained in three blade tracks 148 formed in the tubular body 108. The blades 101 each carry a plurality of cutting elements 104 (e.g., at rotationally leading faces 182 or other desirable locations on the blades 101) for engaging the material of a subterranean formation defining the wall of an open borehole when the blades 101 are in an extended position. The cutting elements 104 may be polycrystalline diamond compact (PDC) cutters or other cutting elements known in the art.

Figure 3:
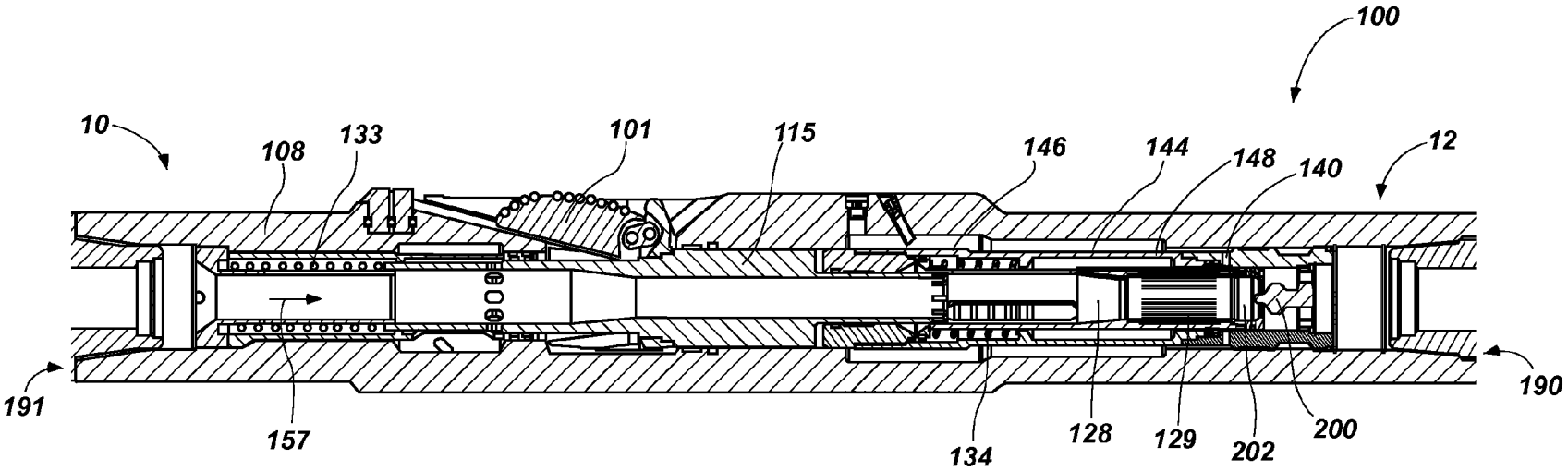
FIG. 3 shows a longitudinal cross-sectional view of the expandable reamer apparatus shown in FIG. 1.

FIG. 3 is another cross-sectional view of the expandable reamer apparatus 100 including blades 101 shown in FIGS. 1 and 2 taken along section line 3-3 shown in FIG. 2. The expandable reamer apparatus includes a top portion 10 and a bottom portion 12. The expandable reamer apparatus 100 may include the push sleeve 115 and the valve piston 128, which are both configured to move axially within the tubular body 108 in response to pressures applied to at least one end surface of each of the push sleeve 115 and the valve piston 128. Before drilling, the push sleeve 115 may be biased toward the distal end 190 of the tubular body 108 by a first spring 133, and the valve piston 128 may be biased toward the proximal end 191 of the tubular body 108 by a second spring 134. The first spring 133 may resist motion of the push sleeve 115 toward the proximal end 191 of the expandable reamer 100, thus maintaining the blades 101 in the retracted position. This allows the expandable reamer 100 to be lowered and removed from a well bore without the blades 101 engaging walls of a subterranean formation surrounding the well bore. The expandable reamer apparatus 100 also includes a stationary valve housing 144 axially surrounding the valve piston 128. The valve housing 144 may include an upper portion 146 and a lower portion 148. The lower portion 148 of the valve housing 144 may include at least one fluid port 140.

Figure 4:
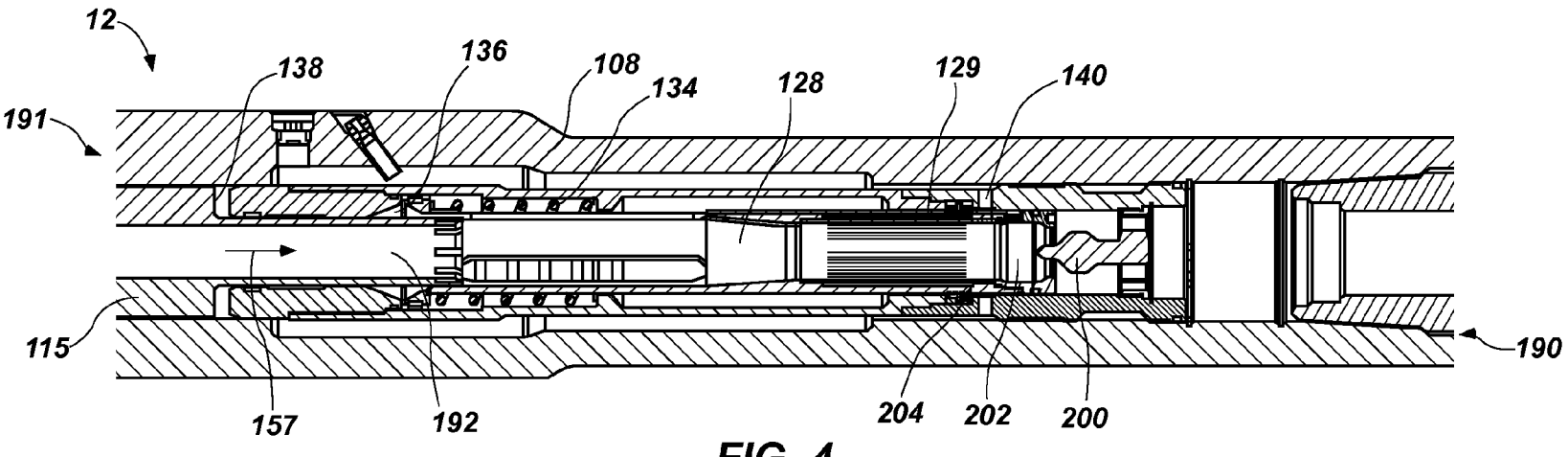
FIG. 4 shows an enlarged cross-sectional view of a bottom portion of the expandable reamer apparatus shown in FIG. 1 when the expandable reamer apparatus is in a retracted position.
Figure 5:
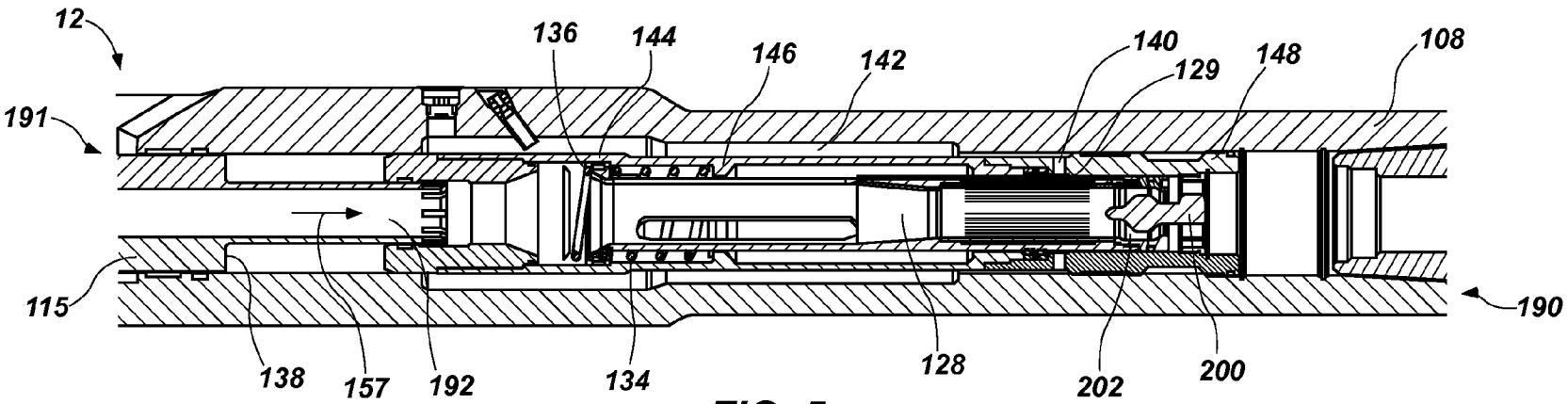
FIG. 5 shows an enlarged cross-sectional view of the bottom portion of the expandable reamer apparatus shown in FIG. 1 when the expandable reamer apparatus is in the extended position.

FIG. 4 is an enlarged view of the bottom portion 12 of the expandable apparatus 100. As shown in FIG. 4, once the expandable apparatus 100 is positioned in the borehole, a fluid, such as a drilling fluid, may be flowed through the fluid passageway 192 in the direction of arrow 157. As the fluid flows through the fluid passageway 192, the fluid exerts a pressure on surface 136 of the valve piston 128 in addition to the fluid being forced through a reduced area formed by a nozzle 202 coupled to the valve piston 128 and a status indicator 200, as described in greater detail below. When the pressure on the surface 136 and the nozzle 202 becomes great enough to overcome the force of the second spring 134, the valve piston 128 moves axially toward the distal end 190 of the tubular body 108. The valve piston 128 includes at least one fluid port 129. When the valve piston 128 travels sufficiently far enough, the at least one fluid port 129 of the valve piston 128 at least partially aligns with the at least one fluid port 140 formed in the lower portion 148 of the valve housing 144 as shown in FIG. 5. Some of the fluid flowing through the fluid passageway 192 travels through the aligned fluid ports 128, 140 into an annular chamber 142 between the valve housing 144 and the tubular body 108. The fluid within the annular chamber 142 exerts a pressure on a surface 138 of the push sleeve 115. When the pressure on the surface 138 of the push sleeve 115 is great enough to contract the first spring 133 (FIG. 3), the push sleeve 115 slides upward toward the proximal end 191, extending the blades 101.

When it is desired to retract the blades 101, the flow of fluid in the fluid passageway 192 may be reduced or stopped. This will reduce the pressure exerted on the surface 136 of the valve piston 128 and the nozzle 202 causing the second spring 134 to expand and slide the valve piston 128 toward the proximal end 191 of the tubular body 108. As the valve piston 128 moves toward the proximal end 191, the at least one fluid port 129 in the valve piston 128 and the at least one fluid port 140 in the valve housing 144 are no longer aligned, and the fluid flow to the annular chamber 142 ceases. With no more fluid flow in the annular chamber 142, the pressure on the surface 138 of the push sleeve 115 ceases allowing the first spring 133 to expand. As the first spring 133 expands, the push sleeve 115 slides toward the distal end 190 of the tubular body 108, thereby retracting the blades 101.

As shown in FIGS. 4 and 5, the valve piston 128 may include a nozzle 202 coupled to a bottom end 204 of the valve piston 128. While the following examples refer to a position of the nozzle 202 within the tubular body 108, it is understood that in some embodiments the nozzle 202 may be omitted. For example, in some embodiments, a status indicator 200, as described in detail herein, may be used to generate a signal indicative of a position of a bottom end 204 of the valve piston 128 relative to the status indicator 200. For example, the signal may comprise a pressure signal in the form of, for example, a detectable or measurable pressure or change in pressure of drilling fluid within the borehole. As shown in FIG. 4, the status indicator 200 may be coupled to the lower portion 148 of the valve housing 144. The status indicator 200 is configured to indicate the position of the nozzle 202 relative to the status indicator 200 to persons operating the drilling system. Because the nozzle 202 is coupled to the valve piston 128, the position of the nozzle 202 also indicates the position of the valve piston 128 and, thereby, the intended and expected positions of push sleeve 115 and the blades 101. If the status indicator 200 indicates that the nozzle 202 is not over the status indicator 200, as shown in FIG. 4, then the status indicator 200 effectively indicates that the blades are, or at least should be, retracted. If the status indicator 200 indicates that the nozzle 202 is over the status indicator 200, as shown in FIG. 5, then the status indicator 200 effectively indicates that the expandable apparatus 100 is in an extended position.

Figure 6:
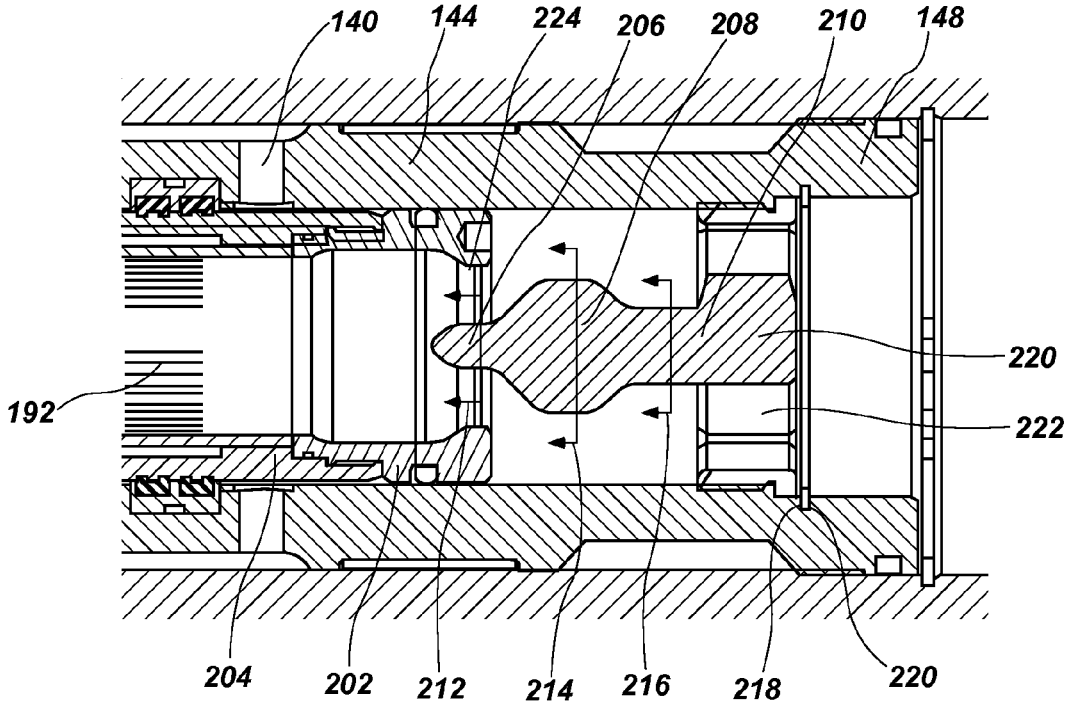
FIG. 6 shows an enlarged cross-sectional view of an embodiment of a status indicator of the present disclosure in the bottom portion of the expandable reamer apparatus shown in FIG. 4.
Figure 8A:
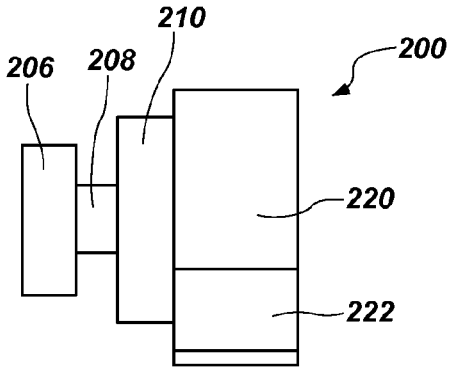
FIGS. 8*a*-8*e* are cross-sectional views of additional embodiments of status indicators of the present disclosure.
Figure 8B:
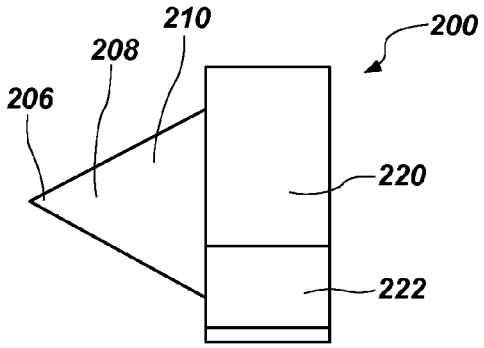
Figure 8C:
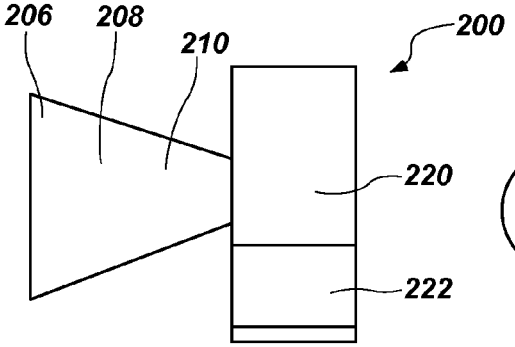
Figure 8D:
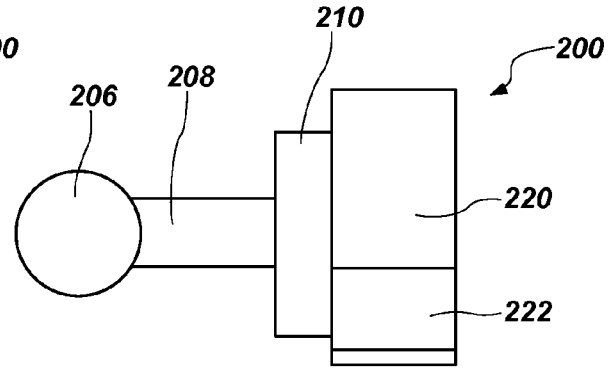

FIG. 6 is an enlarged view of one embodiment of the status indicator 200 when the expandable apparatus 100 is in the closed position. In some embodiments, the status indicator 200 includes at least two portions, each portion of the at least two portions having a different cross-sectional area in a plane perpendicular to the longitudinal axis $L_8$ (FIG. 1). For example, in one embodiment, as illustrated in FIG. 6, the status indicator 200 includes a first portion 206 having a first cross-sectional area 212, a second portion 208 having a second cross-sectional area 214, and a third portion 210 having a third cross-sectional area 216. As shown in FIG. 6, the first cross-sectional area 212 is smaller than the second cross-sectional area 214, the second cross-sectional area 214 is larger than the third cross-sectional area 216, and the third cross-sectional area 216 is larger than the first cross-sectional area 212. The different cross-sectional areas 212, 214, 216 of the status indicator 200 of FIG. 6 is exemplary only and any combination of differing cross-sectional areas may be used. For example, in the status indicator 200 having three portions 206, 208, 210, as illustrated in FIG. 6, additional embodiments of the following relative cross-sectional areas may include: the first cross-sectional area 212 may be larger than the second cross-sectional area 214 and the second cross-sectional area 214 may be smaller than the third cross-sectional area 216 (see, e.g., FIG. 8*a*); the first cross-sectional area 212 may be smaller than the second cross-sectional area 214 and the second cross-sectional area 214 may be smaller than the third cross-sectional area 216 (see, e.g., FIG. 8*b*); the first cross-sectional area 212 may be larger than the second cross-sectional area 214 and the second cross-sectional area 214 may be larger than the third cross-sectional area 216 (see, e.g., FIG. 8*c*). In addition, the transition between cross-sectional areas 212, 214, 216 may be gradual as shown in FIG. 6, or the transition between cross-sectional areas 212, 214, 216 may be abrupt as shown in FIG. 8*a*. A length of each portion 206, 208, 210 (in a direction parallel to the longitudinal axis $L_8$ (FIG. 1)) may be substantially equal as shown in FIGS. 8*a*-8*c*, or the portions 206, 208, 210 may have different lengths as shown in FIG. 8*d*. The embodiments of status indicators 200 shown in FIGS. 6 and 8*a*-8*d* are merely exemplary and any geometry or configuration having at least two different cross-sectional areas may be used to form the status indicator 200.

Figure 8E:
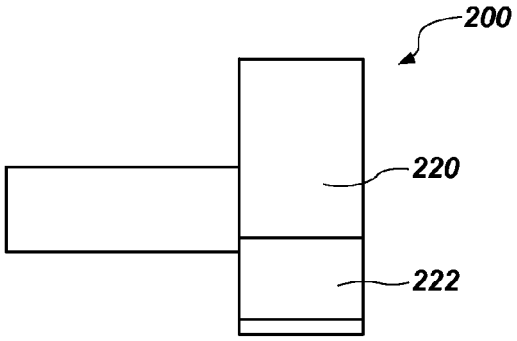

In further embodiments, the status indicator 200 may comprise only one cross-sectional area, such as a rod as illustrated in FIG. 8*e*. If the status indicator 200 comprises a single cross-sectional area, the status indicator 200 may be completely outside of the nozzle 202 when the valve piston 128 is in the initial proximal position and the blades are in the retracted positions.

Continuing to refer to FIG. 6, the status indicator 200 may also include a base 220. The base 220 may include a plurality of fluid passageways 222 in the form of holes or slots extending through the base 220, which allow the drilling fluid to pass longitudinally through the base 220. The base 220 of the status indicator 200 may be attached to the lower portion 148 of the valve housing 144 in such a manner as to fix the status indicator 200 at a location relative to the valve housing 144. In some embodiments, the base 220 of the status indicator may be removably coupled to the lower portion 148 of the valve housing 144. For example, each of the base 220 of the status indicator 200 and the lower portion 148 of the valve housing 144 may include a complementary set of threads (not shown) for connecting the status indicator 200 to the lower portion 148 of the valve housing 144. In some embodiments, the lower portion 148 may comprise an annular recess 218 configured to receive an annular protrusion formed on the base 220 of the status indicator 200. At least one of the status indicator 200 and the lower portion 148 of the valve housing 144 may be formed of an erosion resistant material. For example, in some embodiments, the status indicator 200 may comprise a hard material, such as a carbide material (e.g., a cobalt-cemented tungsten carbide material), or a nitrided or case hardened steel.

Figure 7:
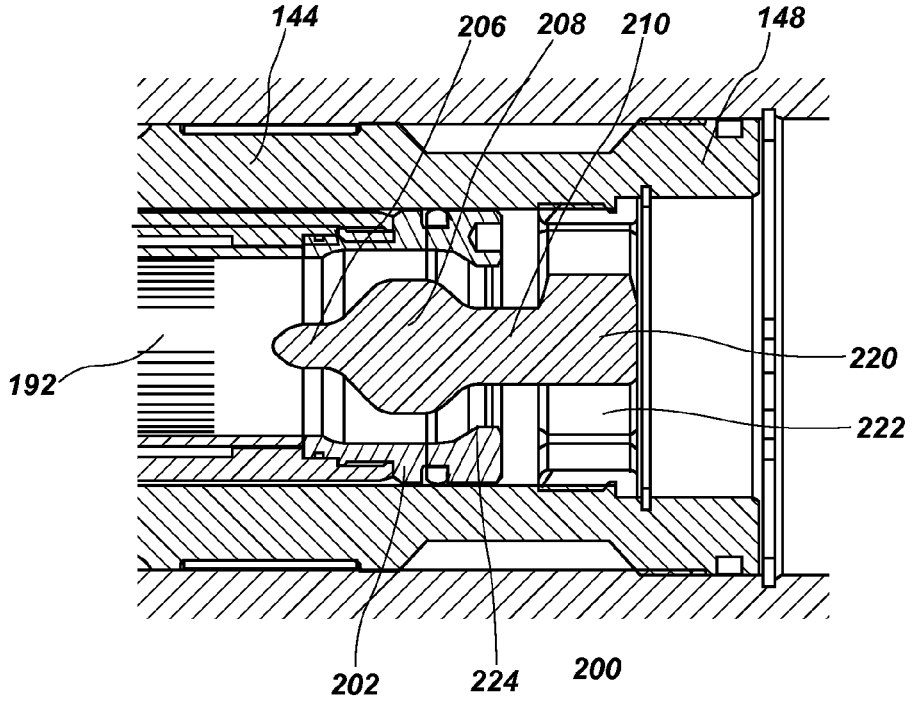
FIG. 7 shows an enlarged cross-sectional view of an embodiment of a status indicator of the present disclosure in the bottom portion of the expandable reamer apparatus shown in FIG. 5.

The nozzle 202 may be configured to pass over the status indicator 200 as the valve piston 128 moves from the initial proximal position into a different distal position to cause extension of the blades. FIG. 7 illustrates the nozzle 202 over the status indicator 200 when the valve piston 128 is in the distal position for extension of the blades. In some embodiments, the fluid passageway 192 extending through the nozzle 202 may have a uniform cross-section. Alternatively, as shown in FIGS. 6 and 7, the nozzle 202 may include a protrusion 224 which is a minimum cross-sectional area of the fluid passageway 192 extending through the nozzle 202.

In operation, as fluid is pumped through the internal fluid passageway 192 extending through the nozzle 202, a pressure of the drilling fluid within the drill string or the bottom hole assembly (e.g., within the reamer apparatus 100) may be measured and monitored by personnel or equipment operating the drilling system. As the valve piston 128 moves from the initial proximal position to the subsequent distal position, the nozzle will move over at least a portion of the status indicator 200, which will cause the fluid pressure of the drilling fluid being monitored to vary. These variances in the pressure of the drilling fluid can be used to determine the relationship of the nozzle 202 to the status indicator 200, which, in turn, indicates whether the valve piston 128 is in the proximal position or the distal position, and whether the blades should be in the retracted position or the extended position.

For example, as shown in FIG. 6, the first portion 206 of the status indicator 200 may be disposed within nozzle 202 when the valve piston 128 is in the initial proximal position. The pressure of the fluid traveling through the internal fluid passageway 192 may be a function of the minimum cross-sectional area of the fluid passageway 192 through which the drilling fluid is flowing through the nozzle 102. In other words, as the fluid flows through the nozzle 102, the fluid must pass through an annular-shaped space defined by the inner surface of the nozzle 202 and the outer surface of the status indicator 200. This annular-shaped space may have a minimum cross-sectional area equal to the minimum of the difference between the cross-sectional area of the fluid passageway 192 through the nozzle 202 and the cross-sectional area of the status indicator 200 disposed within the nozzle 202 (in a common plane transverse to the longitudinal axis $L_8$ (FIG. 1)). Because the cross-sectional area 214 of the second portion 208 of the status indicator 200 differs from the cross-sectional area 212 of the first portion 206, the pressure of the drilling fluid will change as the nozzle 202 passes from the first portion 206 to the second portion 208 of the status indicator 200. Similarly, because the cross-sectional area 214 of the second portion 208 of the status indicator 200 differs from the cross-sectional area 216 of the third portion 210 of the status indicator 200, the pressure of the drilling fluid will change as the nozzle 202 passes from the second portion 208 to the third portion 210.

Figure 9:
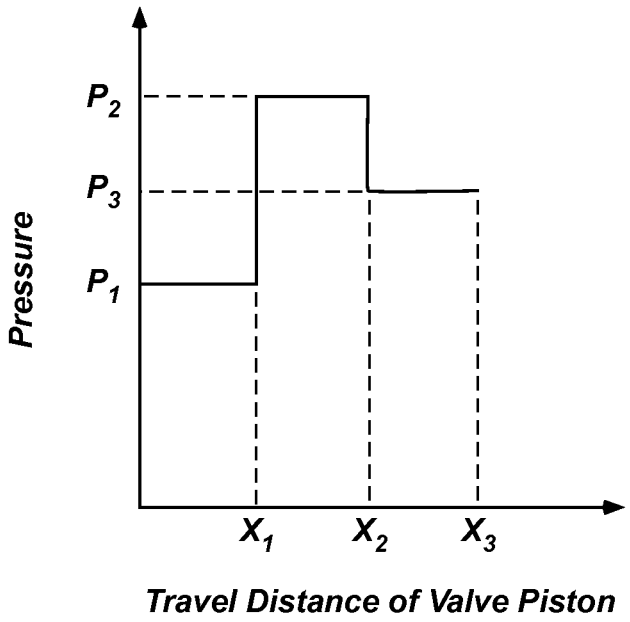
FIG. 9 is a simplified graph of a pressure of drilling fluid within a valve piston as a function of a distance X by which the valve piston travels.

FIG. 9 is a simplified graph of the pressure P of drilling fluid within the valve piston 128 as a function of a distance X by which the valve piston 128 travels as it moves from the initial proximal position to the subsequent distal position while the drilling fluid is flowing through the valve piston 128. With continued reference to FIG. 9, for the status indicator 200 illustrated in FIGS. 6 and 7, a first pressure $P_1$ may be observed the first portion 206 of the status indicator 200 is within the nozzle 202 as shown in FIG. 6. As the expandable apparatus 100 moves from the closed to the open position valve piston 128 moves from the initial proximal position shown in FIG. 6 to the subsequent distal position shown in FIG. 7, a visible pressure spike corresponding to a second pressure $P_2$ will be observed as the protrusion 224 of the nozzle 202 passes over the second portion 208 of the status indicator 200. For example, when the valve piston 128 has traveled a first distance $X_1$, the protrusion 224 will reach the transition between the first portion 206 and the second portion 208 of the status indicator 200, and the pressure will then increase from the first pressure $P_1$ to an elevated pressure $P_2$, which is higher than $P_1$. When the valve piston 128 has traveled a second, farther distance $X_2$, the protrusion 224 will reach the transition between the second portion 208 and the third portion 210 of the status indicator 200, and the pressure will then decrease from the second pressure $P_2$ to a lower pressure $P_3$, which is lower than $P_2$. The third pressure $P_3$ may be higher than the first pressure $P_1$ in some embodiments of the disclosure, although the third pressure $P_3$ could be equal to or less than the first pressure $P_1$ in additional embodiments of the disclosure. By detecting and/or monitoring the variations in the pressure within the valve piston 128 (or at other locations within the drill string or bottom hole assembly) caused by relative movement between the nozzle 202 and the status indicator 200, the position of the valve piston 128 may be determined, and, hence, the position of the blades may be determined. An above-ground pressure indicator may be used to monitor the variations in pressure. For example, a pressure gauge, a pressure transducer, a pressure data acquisition and evaluation system and accompanying pressure display (e.g., an LCD screen) may be located above the ground and may indicate to a user the variations in pressure.

For example, in one embodiment, the status indicator 200 may be at least substantially cylindrical. The second portion 208 may have a diameter about equal to about three times a diameter of the first portion 206 and the third portion 210 may have a diameter about equal to about the diameter of the first portion 206. For example, in one embodiment, as illustrative only, the first portion 206 may have a diameter of about one half inch (0.5"), the second portion 208 may have a diameter of about one and forty-seven hundredths of an inch (1.47") and the third portion 210 may have a diameter of about eight tenths of an inch (0.80"). At an initial fluid flow rate of about six hundred gallons per minute (600 gpm) for a given fluid density, the first portion 206 within the nozzle 202 generates a first pressure drop across the nozzle 202 and the status indicator 200. In some embodiments, the first pressure drop, may be less than about 100 psi. The fluid flow rate may then be increased to about eight hundred gallons per minute (800 gpm), which generates a second pressure drop across the nozzle 202 and the status indicator 200. The second pressure drop may be greater than about one hundred pounds per square inch (100 psi), for example, the second pressure drop may be about one hundred thirty pounds per square inch (130 psi). At 800 gpm, the valve piston 128 begins to move toward the distal end 190 (FIG. 3) of the expandable apparatus 100 causing the protrusion 224 of the nozzle 202 to pass over the status indicator 200. As the protrusion 224 of the nozzle 202 passes over the second portion 208 of the status indicator 200, the cross-sectional area available for fluid flow dramatically decreases, causing a noticeable spike in the pressure drop across the nozzle 202 and the status indicator 200. The magnitude of the pressure drop may peak at, for example, about 500 psi or more, about 750 psi or more, or even about 1,000 psi or more (e.g., about one thousand two hundred seventy-three pounds per square inch (1273 psi)). As the protrusion 224 of the nozzle 202 continues to a position over the third portion 210 of the status indicator 200, the pressure drop may decrease to a third pressure drop. The third pressure drop may be greater than the second pressure drop but less than the pressure peak. For example, the third pressure drop may be about one hundred fifty pounds per square inch (150 psi).

As previously mentioned, in some embodiments, the status indicator 200 may include a single uniform cross-sectional area as shown in FIG. 8*e*. In this embodiment, only a single increase in pressure may be observed as the nozzle 202 passes over the status indicator 200. Accordingly, the more variations in cross-sectional area the status indicator 200, such as two or more cross-sectional areas, the greater the accuracy of location of the nozzle 202 that may be determined.

Although the forgoing disclosure illustrates embodiments of an expandable apparatus comprising an expandable reamer apparatus, the disclosure should not be so limited. For example, in accordance with other embodiments of the disclosure, the expandable apparatus may comprise an expandable stabilizer, wherein the one or more expandable features may comprise stabilizer blocks. Thus, while certain embodiments have been described and shown in the accompanying drawings, such embodiments are merely illustrative and not restrictive of the scope of the disclosure, and this disclosure is not limited to the specific constructions and arrangements shown and described, since various other additions and modifications to, and deletions from, the described embodiments will be apparent to one of ordinary skill in the art. Furthermore, although the expandable apparatus described herein includes a valve piston, the status indicator 200 of the present disclosure may be used in other expandable apparatuses as known in the art.

While particular embodiments of the disclosure have been shown and described, numerous variations and other embodiments will occur to those skilled in the art. Accordingly, it is intended that the invention only be limited in terms of the appended claims and their legal equivalents.

CONCLUSION

In some embodiments, status indicators for determining positions of extendable members in expandable apparatuses comprise at least two portions. Each portion of the at least two portions comprises a different cross-sectional area than an adjacent portion of the at least two portions. The status indicator is configured to decrease a cross-sectional area of a portion of a fluid path extending through an expandable causing a pressure of a fluid within the fluid path to increase when an extendable member of the expandable apparatus is in an extended position.

In other embodiments, expandable apparatuses for use in subterranean boreholes comprise a tubular body having a drilling fluid flow path extending therethrough. A valve piston is disposed within the tubular body, the valve piston configured to move axially downward within the tubular body responsive to a pressure of drilling fluid passing through the drilling fluid flow path. A status indicator is disposed within the longitudinal bore of the tubular body, the status indicator configured to restrict a portion of a cross-sectional area of the valve piston responsive to the valve piston moving axially downward within the tubular body.

In further embodiments, methods of moving extendable members of earth-boring tools comprise flowing a drilling fluid at a first fluid flow rate through a drilling fluid passageway extending through a tubular body. The flow of drilling fluid is increased to a second fluid flow rate and a first pressure causing a valve piston disposed within the tubular body to move axially downward from an upward position to a downward position in response to a pressure of the fluid at the second fluid flow rate upon the valve piston, at least one extendable member configured to extend when the valve piston is in the downward position. At least a portion of a cross-sectional area of the fluid passageway is decreased with a portion of a status indicator as the valve piston moves axially downward causing a pressure of the drilling fluid to increase to a second pressure.

In yet other embodiments, methods for determining whether extending and retracting elements of expandable earth-boring tools are in extended positions or retracted positions comprise flowing working fluid through a fluid passageway extending through a tubular body of an earth-boring tool past a first portion of a status indicator having a first cross-sectional area. A first pressure of the working fluid is measured proximate the first portion. The first pressure is correlated with a retracted position of an expandable portion of the earth-boring tool. Working fluid is flowed through the fluid passageway past a second portion of the status indicator having a second, greater cross-sectional area. A second, higher pressure of the working fluid is measured proximate the second portion. The second, higher pressure is correlated with an extending position of the expandable portion of the earth-boring tool.

What is claimed is:

1. An expandable tool for use in a subterranean borehole, comprising:

a body defining a fluid flow path extending through the body;

a valve piston located within the fluid flow path of the body, the valve piston configured to move longitudinally within the body responsive to drilling fluid flowing through the fluid flow path above a threshold pressure, the valve piston comprising a nozzle defining an opening at an end of the valve piston; and a status indicator located within the flow path of the body, the status indicator being fixed relative to the body, the status indicator positioned and shaped to alter a cross-sectional area of the opening of the nozzle by at least partially entering the nozzle responsive to the valve piston moving longitudinally within the body.

2. The expandable tool of claim 1, wherein the status indicator comprises at least two portions, each portion of the at least two portions exhibiting a different cross-sectional area than an adjacent portion of the at least two portions.

3. The expandable tool of claim 2, wherein a first portion of the at least two portions is located longitudinally closer to the valve piston than a second portion of the at least two portions when the valve piston is located in a first, unmoved longitudinal position, and wherein the first portion exhibits a smaller cross-sectional area than the second portion.

4. The expandable tool of claim 3, wherein the status indicator comprises a third portion located longitudinally farther from the valve piston than the second portion when the valve piston is in the first longitudinal position.

5. The expandable tool of claim 4, wherein a cross-sectional area of the third portion is greater than the cross-sectional area of the first portion and less than the cross-sectional area of the second portion.

6. The expandable tool of claim 1, wherein a biasing element exerts a bias force against the valve piston in a direction longitudinally away from the status indicator.

7. The expandable tool of claim 1, further comprising a valve housing interposed between the valve piston and the body, the valve housing being fixed relative to the body.

8. The expandable tool of claim 7, wherein the status indicator is removably attached to the valve housing.

9. The expandable tool of claim 1, further comprising:

at least one extendable member aligned with an opening through the body, the at least one extendable member configured to move between a retracted position and an extended position;

a push sleeve located at least partially within the body and coupled to the at least one extendable member, the push sleeve configured to move longitudinally responsive to drilling fluid flowing into an axial chamber located between the body and the valve piston above another threshold pressure to extend the at least one extendable member; and at least one fluid port in the valve piston, the at least one fluid port providing fluid communication between the fluid flow path and the axial chamber when the valve piston is at a maximum displacement from its original position.

10. The expandable tool of claim 9, wherein a first portion of the status indicator exhibiting a first cross-sectional area is located within the opening of the nozzle when the at least one extendable member is in the retracted position and another portion of status indicator exhibiting another, different cross-sectional area is located within the opening of the nozzle when the at least one extendable member is in the extended position.

11. The expandable tool of claim 1, further comprising at least one above ground pressure indicator configured to determine a pressure of the drilling fluid flowing through the drilling fluid flow path.

12. A method of moving at least one extendable member of an earth-boring tool, comprising:

flowing a drilling fluid at a first flow rate through a fluid flow path extending through a body;

increasing flow rate of the drilling fluid to a second flow rate and at a threshold pressure causing a valve piston located within the fluid flow path to move longitudinally relative to the body from a first longitudinal position to a second longitudinal position in response to a resultant force of the drilling fluid exerted upon the valve piston, at least one extendable member being extendable from a retracted position to an extended position when the valve piston is in the second longitudinal position; and decreasing a cross-sectional area of an opening of a nozzle movable with the valve piston utilizing a status indicator fixed relative to the body by positioning at least a portion of the status indicator within the opening of the nozzle in response to the valve piston moving longitudinally relative to the body and causing a pressure of the drilling fluid to increase to an indicating pressure responsive to decreasing the cross-sectional area of the opening of the nozzle.

13. The method of claim 12, further comprising determining whether the valve piston is in the first longitudinal position or the second longitudinal position by determining whether the drilling fluid at the second fluid flow rate is at the threshold pressure or the indicating pressure proximate the status indicator.

14. The method of claim 12, wherein decreasing the cross-sectional area of the opening of the nozzle comprises positioning a first portion of the status indicator exhibiting a first cross-sectional area within the opening when the valve piston is located in the first longitudinal position.

15. The method of claim 14, wherein decreasing the cross-sectional area of the opening of the nozzle comprises positioning a second portion of the status indicator exhibiting a second, different cross-sectional area within the opening when the valve piston is located between the first longitudinal position and the second longitudinal position.

16. The method of claim 15, wherein decreasing the cross-sectional area of the opening of the nozzle comprises positioning a third portion of the status indicator exhibiting a third, still different cross-sectional area within the opening when the valve piston is located in the second longitudinal position.

17. A method for determining whether an extendable and retractable member of an expandable earth-boring tool is in an extended position or a retracted position, comprising:

flowing drilling fluid through a fluid flow path extending through a body of an earth-boring tool past a first portion of a status indicator when the first portion of the status indicator is located at least partially within an opening of a nozzle movable with a valve piston located in a first longitudinal position within the body, the first portion exhibiting a first cross-sectional area, the status indicator being fixed relative to the body;

measuring a first pressure of the drilling fluid proximate the first portion when the valve piston is located in the first longitudinal position;

correlating the first pressure with a retracted position of an extendable member of the earth-boring tool;

flowing drilling fluid through the fluid flow path past a second portion of the status indicator when the status indicator is located farther within the opening of the nozzle by moving the valve piston to a second, different longitudinal position within the body, the second portion exhibiting a second cross-sectional area different from the first cross-sectional area of the first portion;

measuring a second, different pressure of the drilling fluid proximate the second portion; and correlating the second, different pressure with a nonretracted position of the extendable member of the earth-boring tool.

18. The method of claim 17, further comprising:

flowing drilling fluid through the fluid flow path past a third portion of the status indicator when the third portion of the status indicator is located proximate the opening of the nozzle by moving the valve piston to a third, still different longitudinal position within the body, the third portion exhibiting a third cross-sectional area different from the first cross-sectional area of the first portion and from the second cross-sectional area of the second portion;

measuring a third pressure of the drilling fluid proximate the third portion, the third pressure being different from the first pressure of the drilling fluid proximate the first portion and from the second pressure of the drilling fluid proximate the second portion; and correlating the third pressure with a fully extended position of the extendable member of the earth-boring tool.

19. The method of claim 18, wherein measuring the third pressure comprises measuring a pressure between the first pressure and the second pressure.

20. The method of claim 17, wherein moving the valve piston to the second, different longitudinal position comprises overcoming a bias force biasing the valve piston toward the first longitudinal position.

* * * * *